United States Patent [19]

Benigni et al.

[11] Patent Number: 4,820,223

[45] Date of Patent: Apr. 11, 1989

[54] SYSTEM AND METHOD FOR MONITORING SPOT-KNOCKING OF CRTS

[75] Inventors: Samuel P. Benigni, Lititz; Richard W. Collins, Pequea, both of Pa.

[73] Assignee: RCA Licensing Corp., Princeton, N.J.

[21] Appl. No.: 201,243

[22] Filed: Jun. 2, 1988

[51] Int. Cl.[4] ..... H01J 9/26

[52] U.S. Cl. ..... 445/6; 445/3; 445/5; 445/63

[58] Field of Search ..... 445/3, 5, 6, 22, 64, 445/72, 62; 315/364; 324/250, 121

[56] References Cited

U.S. PATENT DOCUMENTS

| | | | |
|---|---|---|---|
| 3,698,786 | 10/1972 | Gronka | 445/6 |
| 4,326,762 | 4/1982 | Hockenbrock et al. | 316/1 |
| 4,557,699 | 12/1985 | Bolinsky | 445/6 |
| 4,573,934 | 3/1986 | Strouse | 445/63 |

FOREIGN PATENT DOCUMENTS

| | | | |
|---|---|---|---|
| 3011201 | 10/1981 | Fed. Rep. of Germany | 445/6 |
| 0138119 | 10/1079 | German Democratic Rep. | 445/3 |
| 0111932 | 7/1982 | Japan | 445/63 |
| 0212031 | 12/1983 | Japan | 445/6 |

*Primary Examiner*—Kurt Rowan

*Attorney, Agent, or Firm*—E. M. Whitacre; D. H. Irlbeck; L. L. Hallacher

[57] ABSTRACT

A system and method for monitoring the spot-knocking of electron tubes includes individually identifying each tube carrying hanger and each cart which applies a spot-knocking voltage to the tubes. The hangers and tubes sequentially engage a series of anode bus bar segments and the spot-knocking discharges are counted. The counts for each hanger and for each tube are averaged and compared with stored averages to identify faulty tubes, spot-knocking equipment and carts.

8 Claims, 7 Drawing Sheets

SYSTEM AND METHOD FOR MONITORING SPOT-KNOCKING OF CRTS

BACKGROUND

This invention relates generally to spot-knocking electron tubes and particularly to a system and method for monitoring the spot-knocking of cathode ray tubes (CRT's).

The various electrodes for the electron guns in vacuum tubes, such as cathode ray tubes (CRT'S), typically are made by stamping, shearing and coining processes. The electrodes, therefore, frequently have various surface imperfections, such as burrs. In the assembled electron guns the electrodes are closely spaced. During tube operation each electrode is biased at a different voltage and high voltage differences, as high as 35 kilovolts, therefore are present on the closely spaced electrodes. Under such conditions, the burrs, or other surface imperfections, substantially reduce the spacing between the electrodes and the high voltage difference causes sparking across the burrs and the adjacent electrode. A well known method of removing the undesirable such burrs is a process called spot-knocking. In this process the highest voltage potential electrode, typically the anode, is voltage biased to a very high potential, such as 35 to 40 kilovolts, while the other electrodes are maintained at ground potential. Beneficial sparking is induced by increasing the anode voltage to a level higher than the normal operating voltage. The increase is accomplished by pulsing the anode with an increased voltage, or by applying a radio frequency (rf) component. The combined high potentials cause high voltage discharges, or arcing between the surface imperfections and the electrodes to substantially remove the imperfections.

Typically in the spot-knocking process, the tubes being processed are placed in hangers which move along a conveyor, and which apply the anode potential to the electron guns. Carts, which apply the rf component, move beneath the tubes at the same speed as the conveyor. It is therefore, very difficult to assure that spot-knocking is proceeding in the desired manner because of the inability to observe the tubes during the spot-knocking process. For these reasons it is very difficult to detect improper spot-knocking, which can be caused either by problems within the tube being spot-knocked, or by faulty anode power supplies, or hangers, or rf carts.

For these reasons there is a need for a system and method for automatically monitoring the rf spot-knocking of electron guns within vacuum tubes. The present invention fulfills this need.

SUMMARY

In a system for spot-knocking cathode ray tubes (CRT's) moving along a conveyor on hangers, each of the hangers includes a wiper for applying a high potential to a CRT supported on the hanger, a plurality of anode bus bar segments is arranged along the conveyor to sequentially engage the wiper of a cart moving along the conveyor. A plurality of rf carts move along with the conveyor and apply a rf potential to the tubes in the hangers. Each of the anode bus bar segments is associated with a voltage source for applying a high voltage to the anode bus bar segments. A plurality of sensors are individually arranged in the proximity of the anode bus bar segments. A plurality of counters are individually responsive to the sensors and count the number of discharges occurring along each of the anode bus bar segments. A computer receives and stores the discharge counts. The computer also averages the discharge counts for each of the anode bus bar segments and for each of the carts whereby too low a discharge count can indicate faulty spot-knocking equipment.

DETAILED DESCRIPTION

Figure 1:
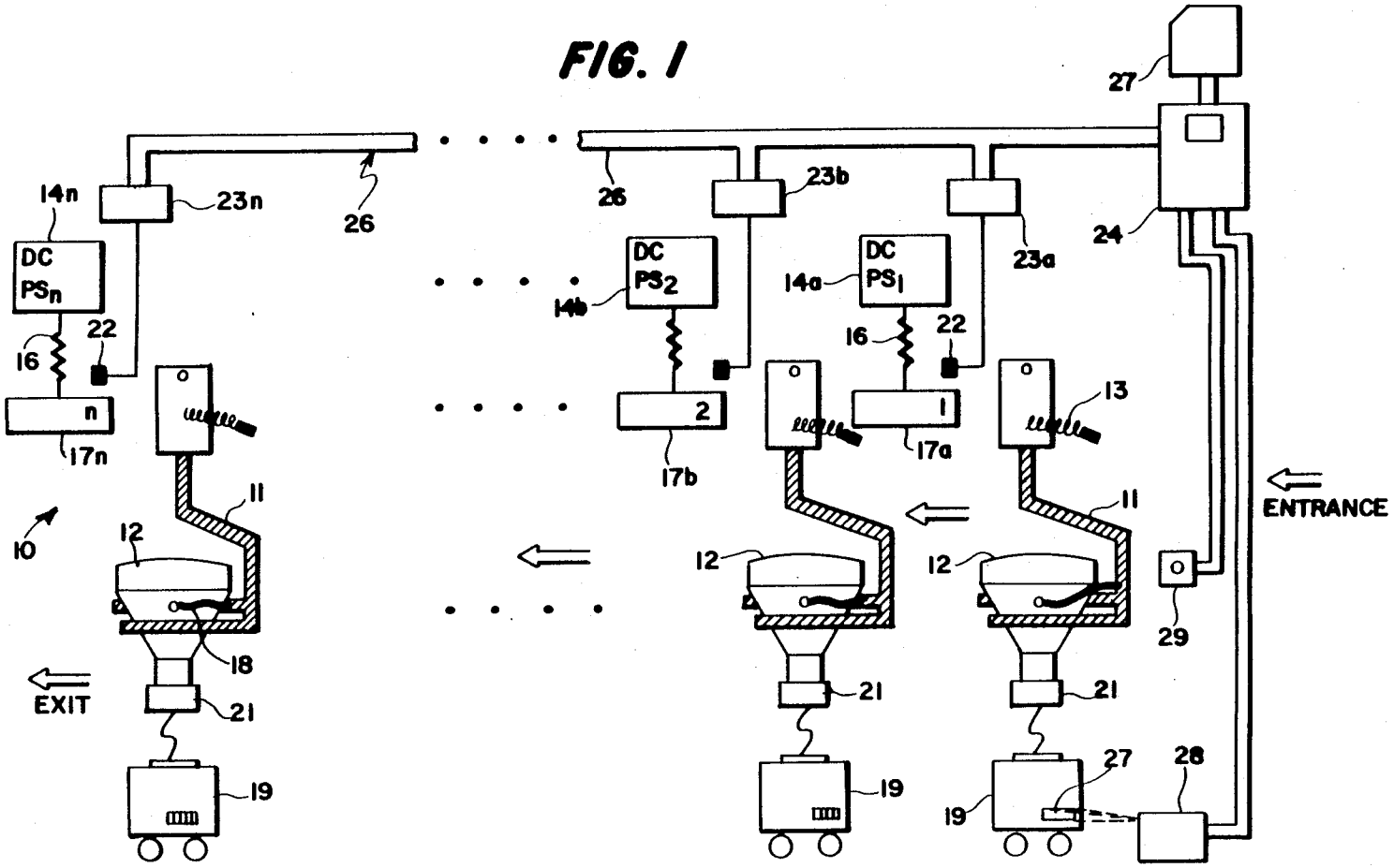
FIG. 1 is a simplified illustration of a preferred embodiment of a system for automatically monitoring the spot-knocking of vacuum tubes.

In FIG. 1, a conveyor 10 includes a plurality of tube hangers 11, each of which carriers a CRT 12. Each of the hangers 11 includes a wiper 13, which is used to electrically couple the CRT 12 to anode power supplies 14, through resistive means 16. A plurality of anode bus bar segments 17*a* through 17*n* are arranged along the conveyor 10 and receive the high voltages from the respective anode power supplies 14*a* through 14*n*. The wipers 13 engage the anode bus bar segments 17 sequentially as the carts 11 move along the conveyor 10, from right to left in the FIGURE. Each of the hangers 11 includes a connector 18 which applies the anode voltage from a supply 14 to the anode of the tube 12.

A plurality of rf carts 19 are arranged to travel along with the hangers 11 and each cart includes a connector 21 to connect the rf spot-knocking potential to the tubes 12. The combined high voltages from the power supplies 14 to the tube anode and the rf voltages cause high voltage discharges between the anode and any surface imperfections on the other electrodes of the gun are substantially removed. Such electrical discharges are detected by capacitive spot-knock sensors 22, which are arranged in the proximity of the anode bus bar segments 17*a* through 17*n*. The spot-knock sensors 22 are individually coupled to counters 23*a* to 23*n*, which are coupled to a computer 24 by a counter data line 26. A printer 25 is coupled to the computer 24 and is used to print count information relative to the rf carts 19, the CRT's 12, the anode power supplies 14, and the tube hangers 11.

Each of the rf carts 19 is uniquely identified, preferably by a bar code label 27. A bar code scanner 28 is arranged to scan and identify the rf carts 19 immediately before the wiper 13 contacts the first anode bus bar segment 17*a*. This identification is used to track the rf carts 19 to assure the operability of the carts and also to identify any tubes which are subsequently determined as having faulty anode electrodes. A tube presence sensor 29 is also arranged in the proximity of the first anode bus bar segment 17*a* and is used to verify that a tube is present on the hanger 11 prior to the engagement of the wiper 13 with the bus bar segment 17*a*.

Briefly stated, in operation as the wipers 13 of the hangers 11 engage the anode bus bar segments 17*a* through 17*n* the associated counters 23 for all of the bus bar segments simultaneously count spot-knocking discharges. Accordingly, as a particular rf cart 11 is tracked along the anode bus bar segments 17*a* to 17*n* the discharge counts are tracked and low counts occasioned by a faulty rf cart are distinguishable from low counts occasioned by a faulty anode power supply 14. Also, high counts occasioned by a faulty tube are detected and used to identify the faulty tube.

The computer 24 uses one data file to store the statistics for the various anode supplies 14 and a second file to store the statistics for the rf carts 19. The anode data file consists of one line of data for each of the power supplies 14. Thus, each particular line of the anode file contains the following statistics:

(a) the number of times (N) that particular anode power supply processes a tube, (b) the accumulated sum of discharge counts for that particular supply, (c) the average discharge count obtained for that particular supply, and (d) the standard deviation for the discharge counts from the mean.

The rf cart file is handled in essentially the same manner in that each rf cart is represented by one line of data in the rf data file.

Figure 2:
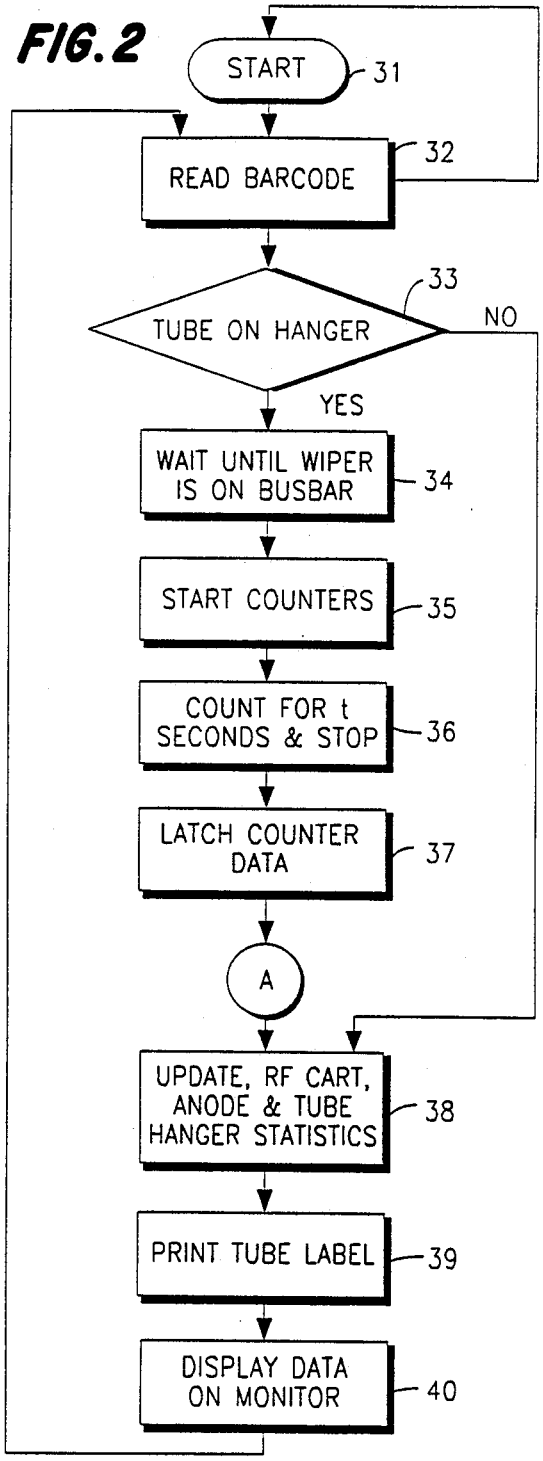
FIG. 2 is a flow chart of a preferred embodiment of a method for automatically monitoring the spot-knocking of vacuum tubes.

FIG. 2 is a flow chart of a preferred method of automatically monitoring the spot-knocking of vacuum tubes. The method starts at step 31 and at step 32 the bar code label 27 present on each of the rf carts 19 is scanned by the bar code reader 28 to specifically identify the rf cart which carries the next tube to be spot-knocked. At decision 33 the tube presence sensor 29 verifies whether or not a tube 12 is present on the carrier 11 which is about to contact the first anode bus bar segment 17*a*. When a tube is not on a hanger, step 38 is entered to update the rf cart, the anode and the tube hanger statistics. This updating is fully described hereinafter with respect to FIGS. 3 and 4. At decision 33 when a tube is present on the hanger, step 34 is entered and nothing occurs until the wiper 13 of the hanger contacts the bus bar segment 17*a*. In step 35, when the wiper 13 contacts the bus bar segment 17*a*, the counter 23 is initiated. In step 36 the counter 23 counts for a predetermined number of seconds t and automatically stops when the time t has expired. Accordingly, the number of spot-knocking arcs which occurs during the preselected time t is recorded for each of the bus bar segments 17*a* through 17*n*. At the expiration of the predetermined time t, the counter is stopped, and at step 37 the counter data are latched. Step 38 is then entered, as indicated by the balloon A, to update the rf cart, the anode and tube hanger statistics. Again, this updating is fully described hereinafter with respect to FIGS. 3 and 4. At the end of the updating steps 39 and 40 are entered to print the tube label and to display the data on the monitor, respectively. Step 32 is then re-entered to read the bar code on the next incoming rf cart 19.

Figure 3:
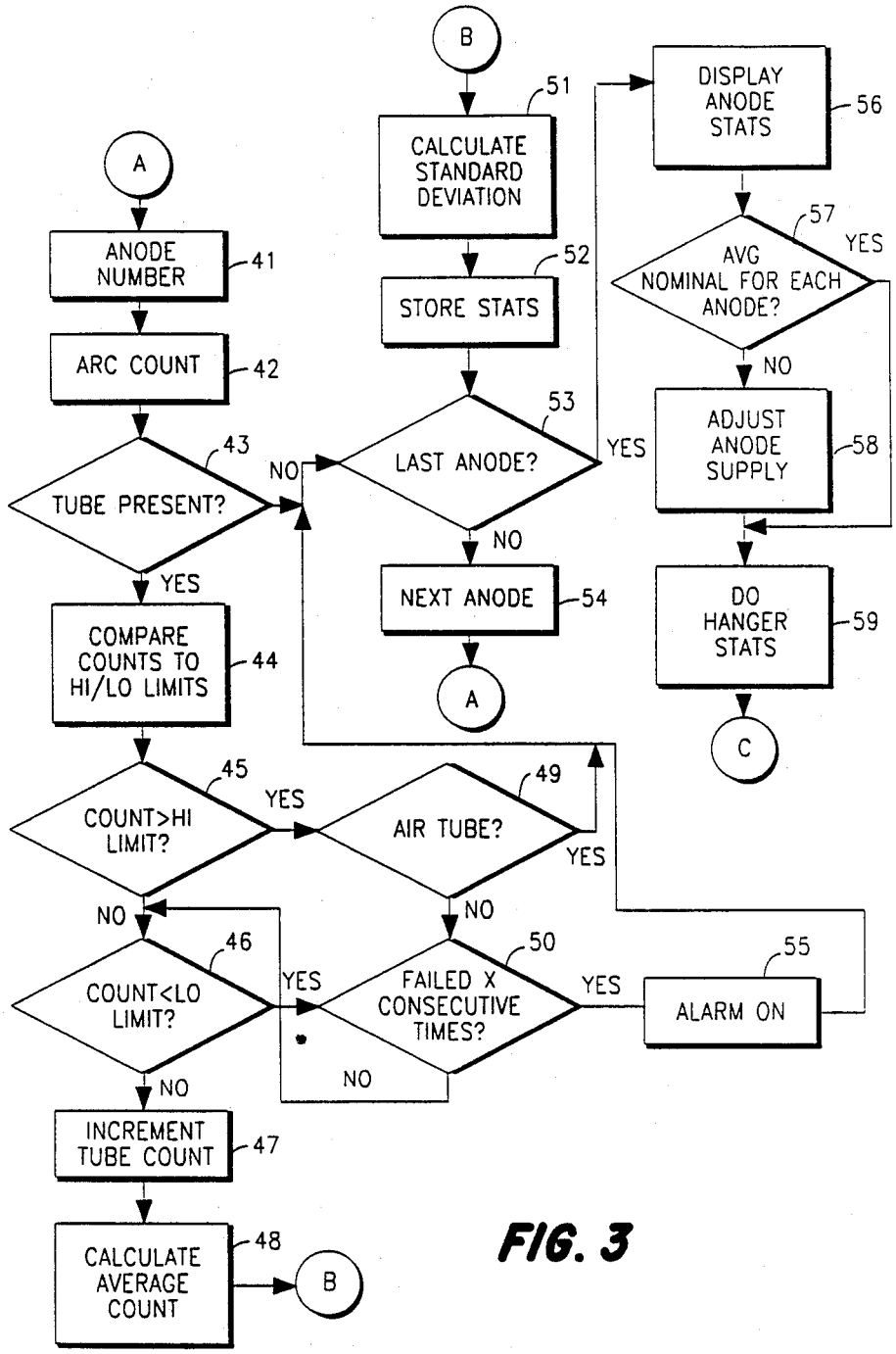
FIG. 3 is a flow chart of a preferred embodiment for identifying improper spot-knocking caused by tube failures, or a faulty anode power supply, or a faulty tube hanger.

FIG. 3 is a flow chart showing how the anode supply data are tracked and also how the rf cart and tube hanger statistics are updated in block 38 of FIG. 2. As shown by balloon A, the routine is entered from block 37 of the flow chart of FIG. 2 and at step 41 the number of the anode power supply 23*a* to 23*n* being processed is recorded. At step 42, the number of arc counts detected during the time t that the counter is on are recorded for each of the anode bus bar segments 17*a* through 17*n*. Thus, the are count for every tube is recorded for each of the anode bus bar segments 17*a* through 17*n*. At decision 43 the tube presence sensor 29 (FIG. 1) indicates whether or not a tube is present on the hanger 11 which is about to engage bus bar segment 17*a*. When no tube is present, decision 53 is entered to determine whether or not the last tube to be checked has been checked. When it has not, step 41 is re-entered to begin checking the tube present on the next incoming hanger. At decision 53 when the last anode has been checked steps 56 through 58 are entered to record the anode power supply data. Returning to decision 43, when a tube is present, step 44 is entered to compare the arc counts detected to the high and low limits which are set into the system. The anode voltage supplies 14*a* through 14*n* typically are divided into three sets, and each set applies a higher voltage than the preceding set. Accordingly, the anode voltage is gradually increased in three increments as the tube progresses along the anode bus bar segments 17*a* through 17*n*. The number of counts for an acceptable tube therefore also can be adjusted because a higher number of arcs can be expected as the anode voltage is increased. The number of counts to be expected is dependent upon the particular type of tube being tested and the selection of the high and low counts is within the purview of one skilled in the art. At decision 45, the arc count is compared to the high selected number and when the count exceeds the number decision 49 is entered to indicate whether or not the tube is an air tube. An air tube is indicated when the arc count exceeds the selected number by a predetermined multiplier, such as two. When the tube is an air tube, the tube is rejected, and decision 53 is entered. When step 49 indicates that the tube is not an air tube step 50 is entered to determine whether or not the particular anode power supply 14*a* through 14*n* has failed a predetermined number of consecutive times. When it has, step 55 is entered to turn on the alarm to indicate that the particular anode power supply should be checked. At step 50 when the particular power supply has not failed for the required number of consecutive times, decision 46 is entered. Returning to decision 45, when the count is not too high, step 46 is entered to determine whether or not the count is low. When the count is low, decision 50 is again entered to determine whether or not the count has failed for a predetermined number of consecutive times. When it has, a bad power supply is indicated, and the alarm is turned on at step 55. When both the high and low comparisons are acceptable, step 47 is entered to increment the tube count, and step 48 is then entered to calculate the average count for the particular tube being checked. Step 51 is then entered to calculate the standard deviation for the counts, and step 52 is entered to store the statistics for the particular anode being checked. Decision 53 is then entered to determine whether or not the last anode has been checked, and when it has not, step 41 is re-entered to increment to the next anode power supply. In decision 53 when the last tube has been checked, steps 56 through 58 are sequentially accomplished to display the anode statistics and to average the nominal for each of the tubes which has been checked. Step 58 is utilized to adjust the anode power supplies, if necessary, to fine tune the average nominal count for each tube. Step 59 is then entered to do the statistics for each of the tube hangers 11. The gathering of the tube hanger statistics is similar to the gathering of those for the anode power supplies 14, and, accordingly, the flow chart of FIG. 3 is also descriptive of this data accumulation.

Figure 4:
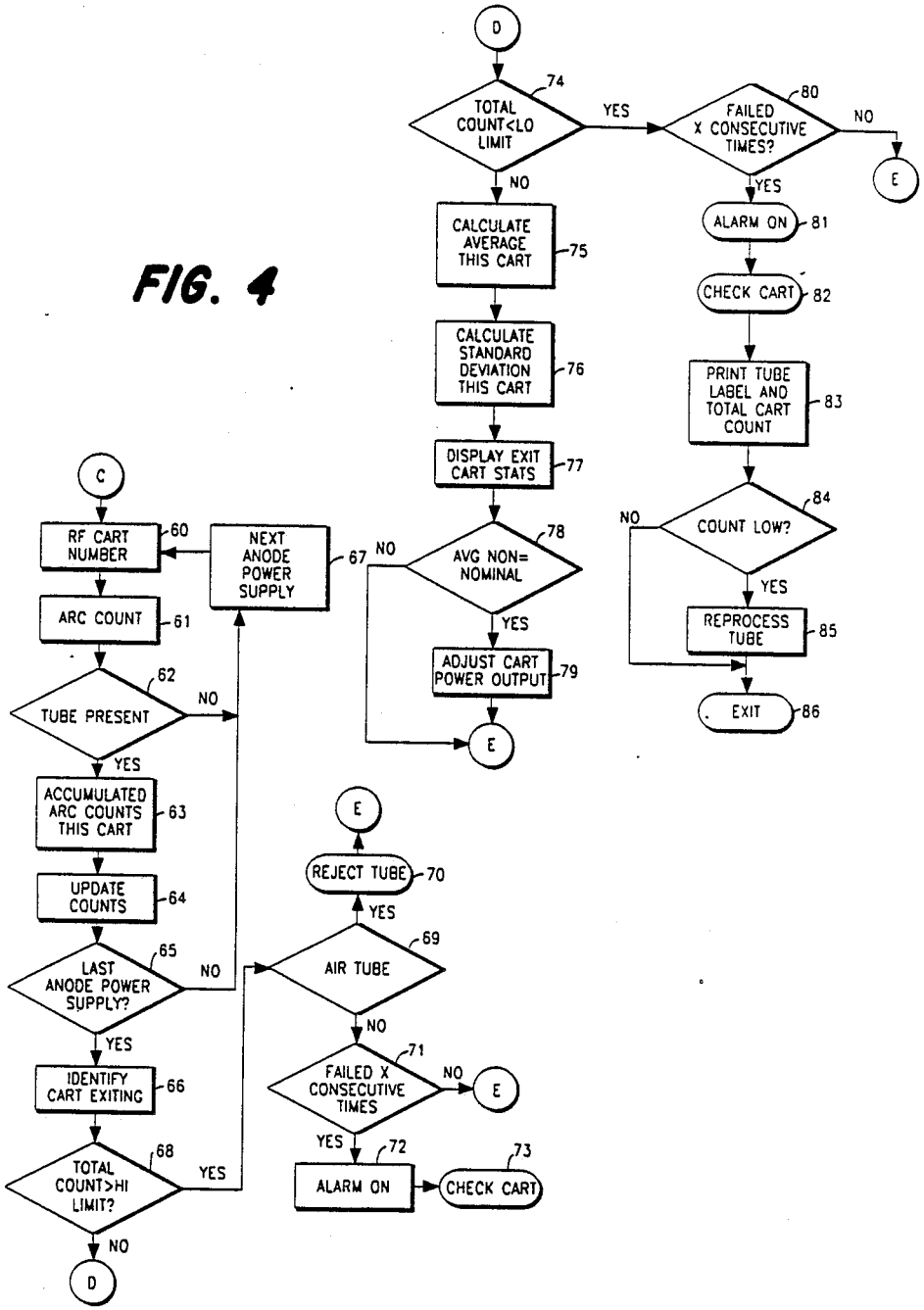
FIGS. 4, 4A and 4B are a flow chart of a preferred embodiment for identifying improper spot-knocking caused by faulty rf equipment and also for updating the tube and equipment statistics.
Figure 4A:
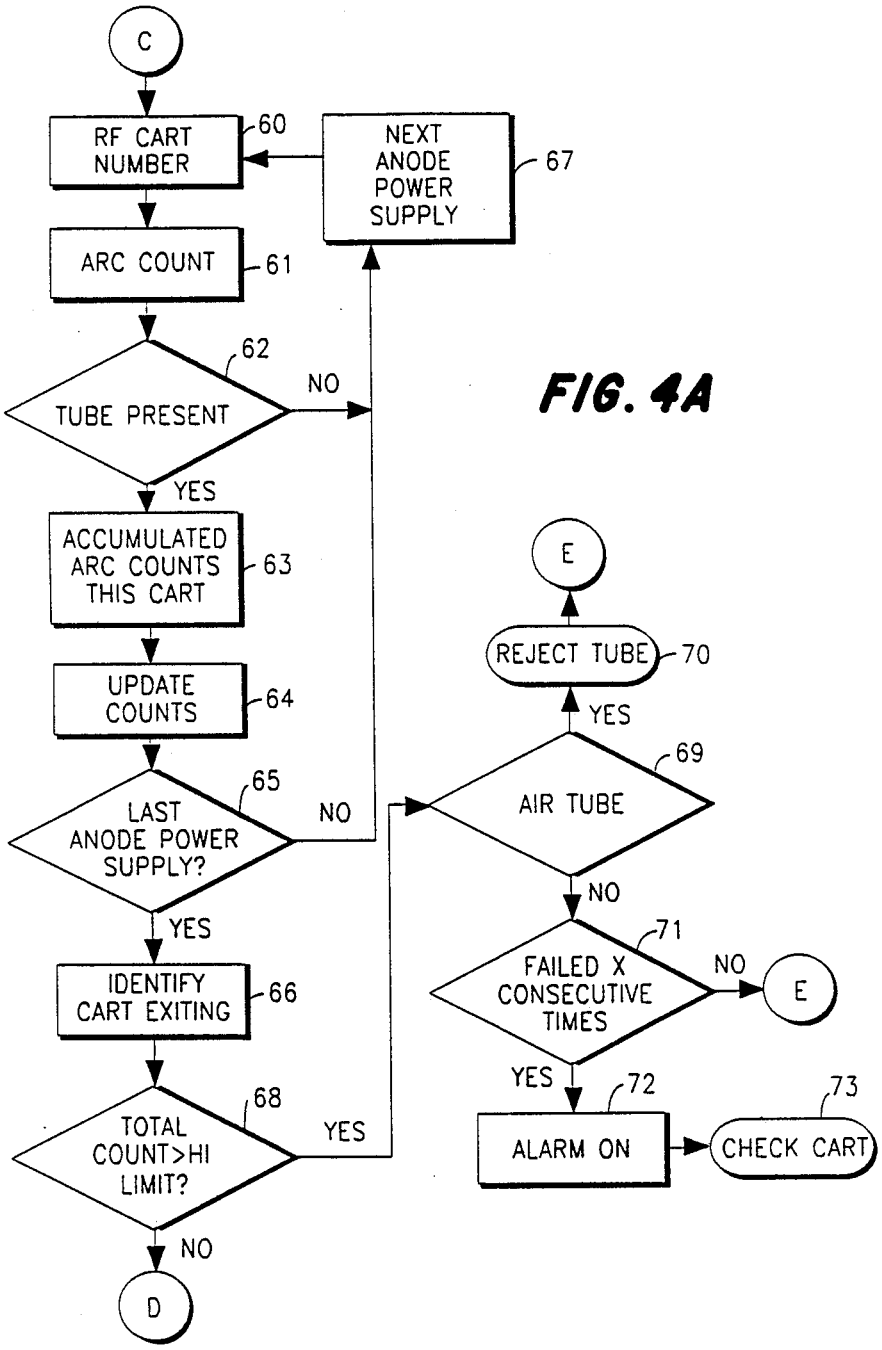
Figure 4B:
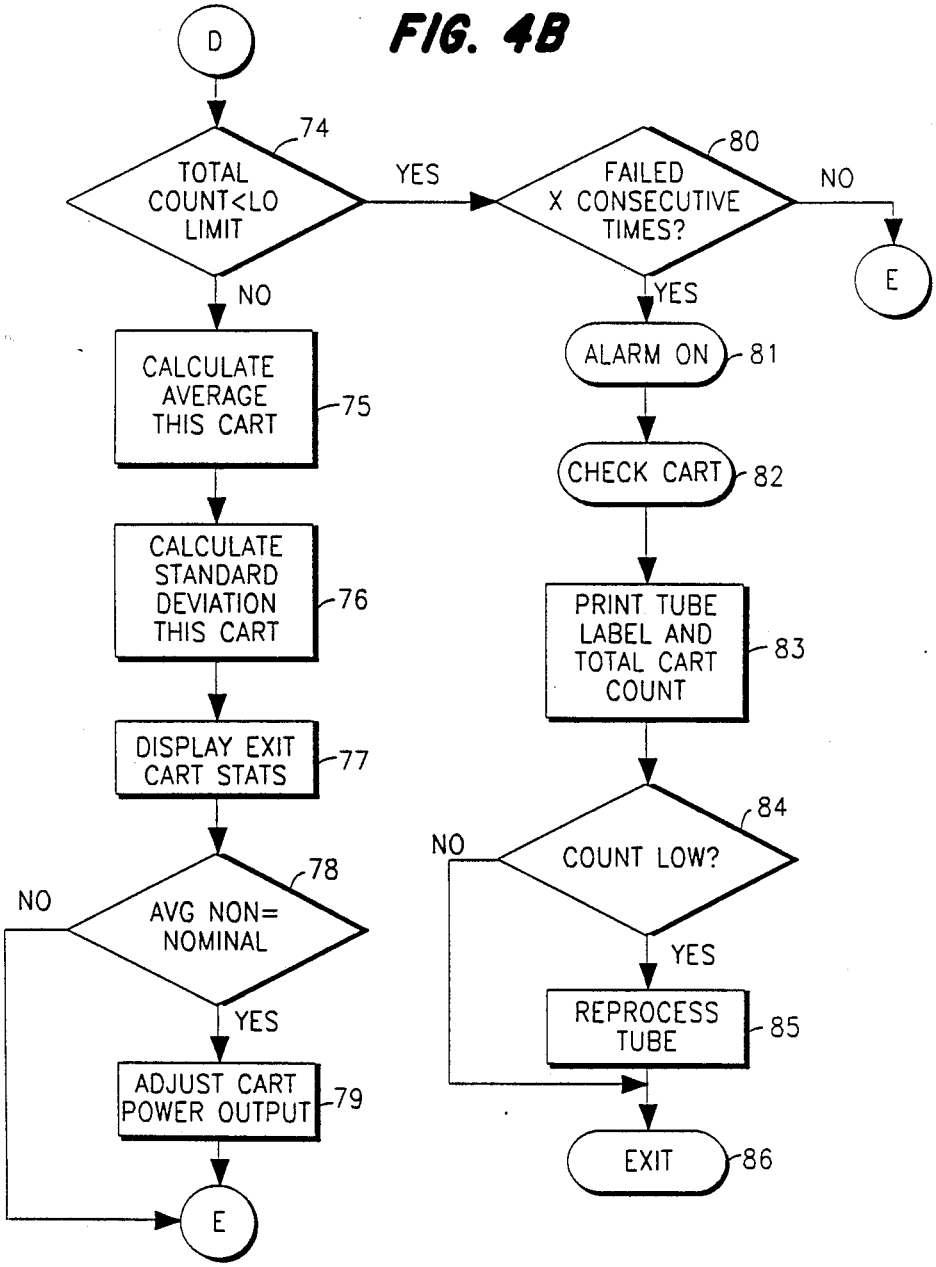

FIG. 4 is a flow chart showing how the data for the rf carts of FIG. 1 are gathered and processed to identify malfunctioning carts. At step 60, the rf cart number is received from the bar code scanner 28. At step 61, the arc count for the particular position is obtained. At decision 62, the tube presence sensor 29 (FIG. 1) is checked. When a tube is not present, step 67 is entered to increment to the next anode power supply, and step 60 is re-entered to read the next rf cart number. At decision 62 when a tube is present, step 53 is entered to get the accumulated arc counts for the rf cart identified by the bar code reader 28. At step 64, the accumulated counts for the particular anode bus bar segment being investigated is updated. Decision 65 is then entered to determine whether or not the last anode power supply supplied the data. When it has not, step 67 is re-entered to increment to the next anode power supply. In decision 65 when the last anode power supply has been checked, step 66 is entered to identify the rf cart which is exiting from the conveyor 10. Decision 68 is then entered to compare the total counts for the particular rf cart to the high limit. When the limit is high, decision 69 is entered to determine whether or not the tube is an air tube. When the tube is an air tube, step 70 is entered to reject the tube. When it is not an air tube, step 71 is entered to determine whether or not the particular rf cart has failed for a predetermined number of consecutive times. When it has, the alarm is turned on, and step 73 is entered to tell the operator to check the particular rf cart. In decision 68, when the total count accumulation is below the high limit, step 74 is entered to determine whether or not the total count is less than the low limit set. When the count is low, step 80 is entered to determine whether or not the rf cart has failed for a predetermined number of consecutive times. When it has not, step 83 is entered to print the tube label and the total rf cart count. Returning to decision 74, when the total accumulated count is above the low limit, step 75 is entered to calculate the average count for the particular rf cart. Step 76 is then entered to calculate the standard deviation for that cart. At step 77 the statistics for the particular rf cart which is exiting from the conveyor system 10 are displayed. At decision 78, the average count is compared to determine whether or not it is out of the nominal average. When the average is slightly different from the nominal average, step 79 can be utilized to adjust the rf cart power output. Step 83 is entered to print the tube label and the total cart count. Decision 84 is entered to determine whether or not he count is low. When the count is low, step 85 is entered to reprocess the tube, and when the count is not low, the routine is exited as indicated at step 86.

Figure 5:
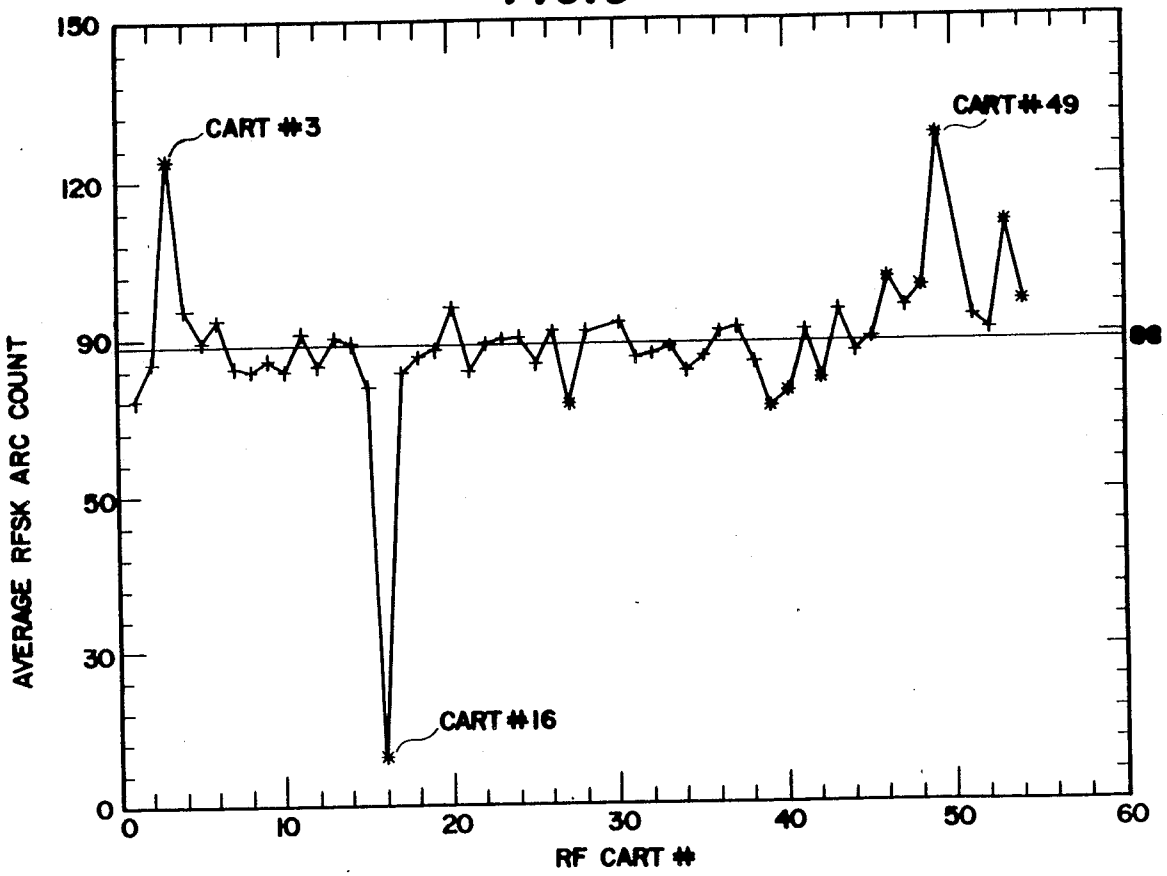
FIG. 5 is a graph showing how spot-knocking faults of various types are identified.

FIG. 5 is an example of a graph which can be received from the printer 27. In FIG. 5, the average number of counts is shown to be approximately 88. However, the counts for cart numbers 3 and 49 are substantially above the average count, thereby indicating that bad tubes are on hangers number 3 and 49. The count for rf cart number 16 is substantially below the average count, thereby suggesting that rf cart number 16 is faulty and should be checked. The same type of graphs can be plotted to display the statistics for the anode power supplies 23*a* to 23*n*.

What is claimed is:

1. In a system for spot-knocking cathode ray tubes (CRT's) carried along a conveyor on hangers, each of said hangers having a wiper for applying a high anode potential to a CRT supported on said hanger, said system also including a plurality of carts moving along with said conveyor for applying a spot-knocking potential to said tubes an improvement comprising:

a plurality of anode bus bar segments arranged along said conveyor to sequentially engage the wiper of a tube hanger moving along said conveyor; each of said anode bus bar segments being associated with a voltage source for applying a high voltage to said anode bus bar segments;

a plurality of sensor means individually arranged in the proximity of said anode bus bar segments, said sensor means sensing spot-knocking discharges within said CRT;

a plurality of counter means individually responsive to said sensor means for counting the number of discharges occurring along each of anode said bus bar segments;

computer means for receiving and storing said discharge counts, said computer means also averaging said discharge counts for each of said anode bus bar segments, for each of said hangers, and for each of said carts whereby too low a discharge count can indicate faulty spot-knocking equipment, and too high a count can indicate a faulty tube.

2. The improvement of claim 1 further including a tube sensor for sensing tubes in said carts and for indicating empty carts to said computer.

3. The improvement of claim 2 further including means for identifying said carts prior to engaging said anode bus bar segments whereby said computer can identify faulty carts.

4. A method of monitoring the spot-knocking of cathode ray tubes (CRT's) comprising the steps of:

individually identifying hangers which carry said tubes and which couple said tubes to anode voltages;

individually identifying carts which apply spot-knocking voltages to said tubes;

sequentially coupling said hangers to a plurality of anode bus bar segments and counting the number of spot-knocking discharges for each of said segments:

recording the number of spot-knocking discharge counts for each of said segments and for each of carts and comparing said counts with acceptable counts whereby excessively high counts indicate faulty tubes and excessively low counts indicate faulty carts and faulty spot-knocking equipment.

5. The method of claim 4 further including the step of averaging the number of spot-knocking discharge counts for each of said carts for all of said segments and for all of said tubes to obtain a cart average number of discharge counts per tube, and comparing said cart average number of discharges per tube to a stored cart average to identify faulty carts and spot-knocking equipment.

6. The method of claim 5 further including the step of averaging the number of spot-knocking discharge counts for each of said tubes for all of said segments to obtain a segment average number of discharges per tube, and comparing said segment average to a stored segment average to identify faulty tubes.

7. The method of claim 6 further including the step of sensing the presence of a tube in said carts to eliminate empty carts form said cart average.

8. The method of claim 4 further including the step of averaging the number of spot-knocking discharge counts for each of said tubes for all of said segments to obtain a segment average number of discharges per tube, and comparing said segment average to a stored segment average to identify faulty tubes.

* * * * *